United States Patent [19]

Pedder et al.

[11] 4,317,063

[45] Feb. 23, 1982

[54] PYROELECTRIC DETECTORS

[75] Inventors: David J. Pedder, Oxford; David J. Warner, Northampton, both of England

[73] Assignee: Plessey Handel und Investments AG, Zug, Switzerland

[21] Appl. No.: 88,169

[22] Filed: Oct. 25, 1979

[30] Foreign Application Priority Data

Oct. 28, 1978 [GB] United Kingdom ..... 42361/78
Oct. 28, 1978 [GB] United Kingdom ..... 42362/78
Oct. 28, 1978 [GB] United Kingdom ..... 42363/78

[51] Int. Cl.[3] ..... H01J 29/45
[52] U.S. Cl. ..... 313/388; 313/101
[58] Field of Search ..... 136/213; 252/500; 313/14, 101, 385, 388

[56] References Cited

U.S. PATENT DOCUMENTS

| | | | |
|---|---|---|---|
| 2,299,260 | 10/1942 | Sivian | 310/306 |
| 2,317,523 | 4/1943 | Delano | 310/306 |
| 3,278,783 | 10/1966 | Brissot et al. | 136/213 |
| 3,453,432 | 7/1969 | McHenry | 136/213 |
| 3,700,503 | 10/1972 | Fletcher | 136/213 |
| 4,024,420 | 5/1977 | Anthony et al. | 136/202 |
| 4,053,806 | 10/1977 | Turnbull et al. | 313/101 |
| 4,180,759 | 12/1979 | Harris et al. | 313/101 |

*Primary Examiner*—Edward A. Miller
*Attorney, Agent, or Firm*—Fleit & Jacobson

[57] ABSTRACT

A reticulated pyroelectric target, for the detection of infra red radiation, comprising a plurality of closely packed islands of pyroelectric material separated by a plurality of relatively narrow grooves in which in order to physically strengthen the target the islands and grooves are so shaped that the grooves do not form a straight line over any appreciable portion of the target surface. Preferably the islands are hexagonal to provide a good packing density.

8 Claims, 7 Drawing Figures

PYROELECTRIC DETECTORS

The present invention relates to pyroelectric detectors and more particularly to improved reticulation structures for pyroelectric targets.

The spatial resolution of the pyroelectric vidicon is fundamentally limited by the thermal diffusivity of the pyroelectric target material. This can be improved by the use of a simple reticulation structure consisting of a regular array of square islands supported on a thin plastic support layer to provide thermal insulation and thereby reduce thermal spread.

The reticulation of such targets however has produced a number of problems which are at least partially solved by this invention.

The present invention is concerned with the weakness caused in the simple square reticulated structure by the grooves in the pyroelectric material. After reticulation the deformation and distortion of the target will be constrained into the grooves and will cause distortion of the pyroelectric target.

It is an object of the present invention to provide a reticulated pyroelectric target in which the problem of distortion and/or deformation is considerably reduced.

The present invention, therefore, provides a reticulated pyroelectric target comprising a plurality of islands of pyroelectric material separated by a plurality of grooves, in which each island is shaped such that the grooves do not form a straight line over any appreciable portion of the target surface.

In a preferred embodiment the islands are hexagonal and form a close-packed hexagonal array. Preferably the hexagon is formed with internal angles of 120° or 90° and 135° to give a regular or elongated hexagonal array. Such structures provide a higher density of islands per unit area and are more isotropic than a square array of similar pitch and groove width. While circular islands in a close-packed array can also be employed, a hexagonal island provides a more rigid structure and a lower kerf loss at a given island separation. The island separation is preferably less than $\frac{1}{4}$ the pitch of the structure and less than the wavelength of the infra-red radiation being detected (8–14 $\mu$m).

The present invention is also concerned with correcting a defect produced by the fact that the grooves separating the islands of the reticulated target are perpendicular to the plane of the target.

The present invention therefore also provides a reticulation structure for a pyroelectric vidicon target in which the grooves separating the islands of the reticulated target are inclined at an acute angle with respect to the plane of the target.

The size of the acute angle necessary depends on the depth and on the width of the grooves separating the islands.

In addition the present invention is concerned with alleviating the stresses produced in the target during the reticulation process. The method of reticulation at present employed is to use an ion beam to mill out the grooves. The target is restrained in a holder which clamps the edges of the target. This clamping is found to produce wrinkles or folds in the target when it is removed from the clamps and, therefore, distortion in the image provided by the detector. If the target is not restrained during reticulation then the target is found to progressively bow upwards during the run, leading to the different regions of the target being reticulated at different reticulation angles.

The present invention, therefore, provides a means for maintaining the target substantially flat during the reticulation process.

According to a further aspect of the present invention there is provided a holder for retaining the pyroelectric target substantially flat during reticulation of the target said holder comprising a plurality of fingers projecting inwardly from one or more support means, said support means being provided with a central aperture such that the support means does not cover the whole of the target during recticulation.

Preferably the support means is annular in form for use with a disc shaped target.

The target produced by the reticulation process is preferably reticulated right to the edge of the disc and this, therefore, relieves the stresses produced during the reticulation process.

Embodiments of the present invention will now be described, by way of example with reference to the accompanying drawings in which.

Figure 1:
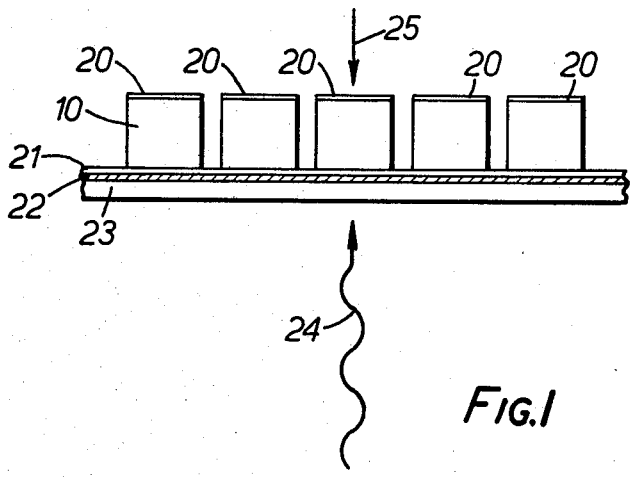
FIG. 1 shows a sectional view of a known pyroelectric target.
Figure 3:
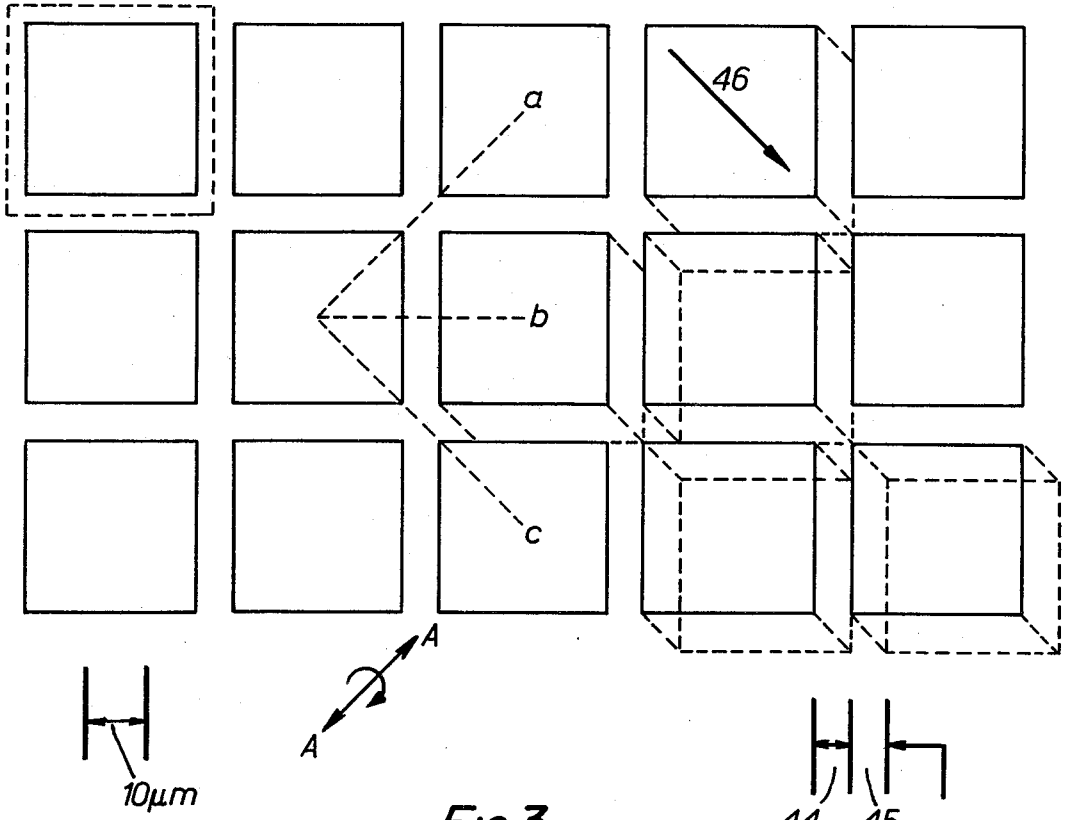
Figure 4:
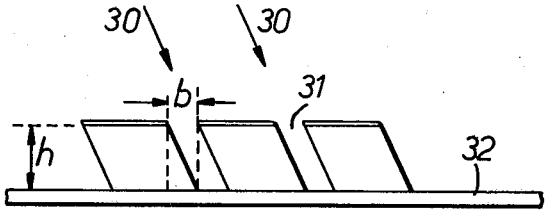
Figure 7:
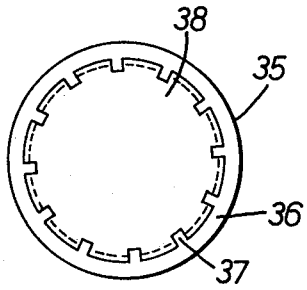
Figure 5:
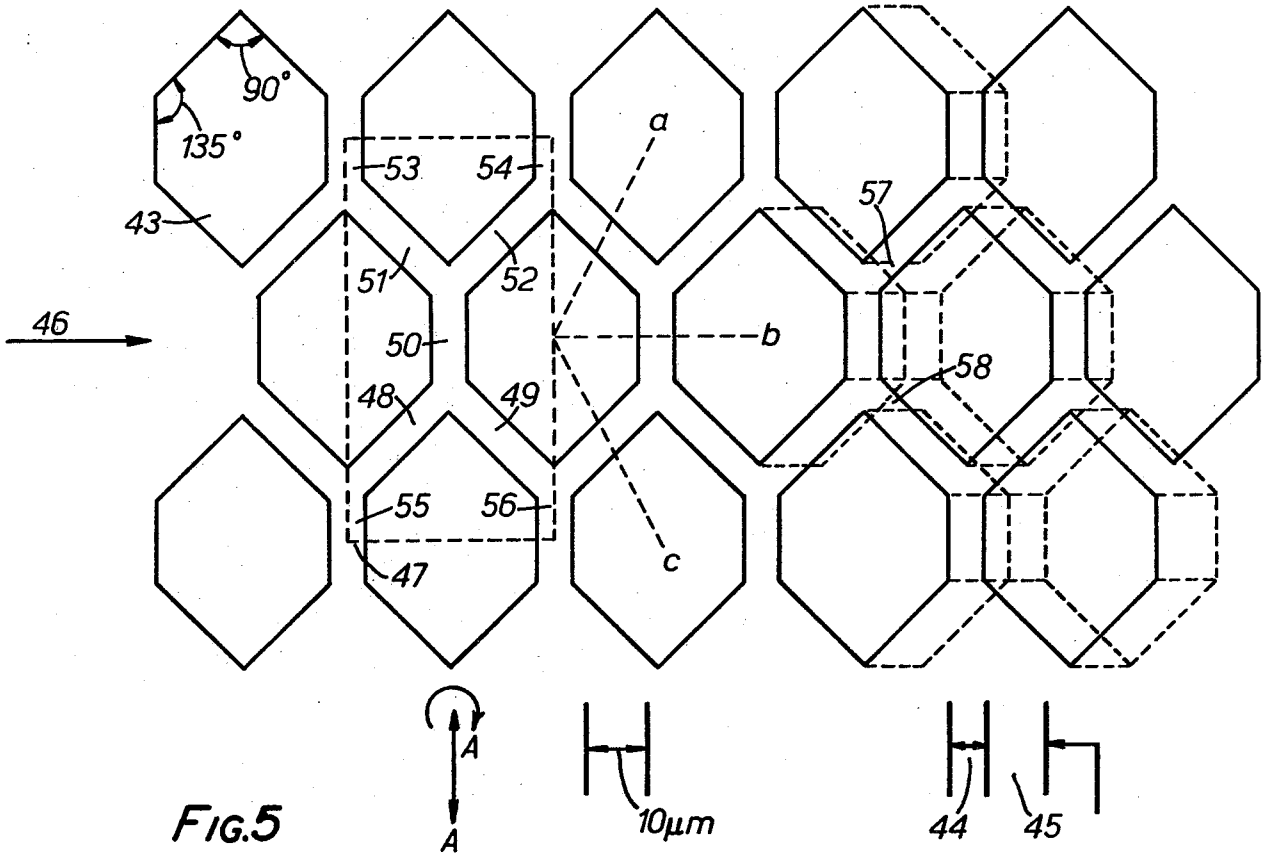
Figure 6:
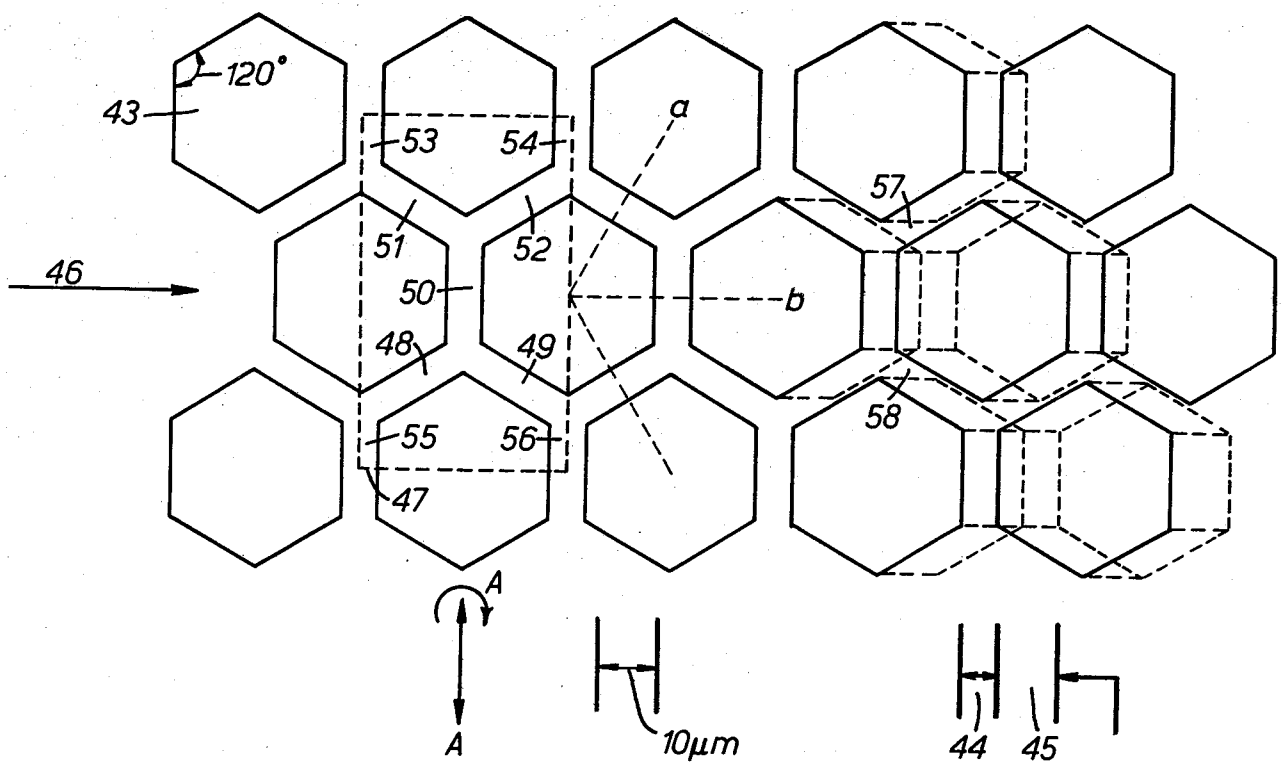

FIG. 3 shows a plan view of a known square reticulated target for comparison with the targets shown in FIGS. 3 and 4, FIG. 4 shows a sectional view of a known reticulated target, FIG. 5 shows a plan view of a first reticulated pyroelectric target according to the present invention FIG. 6 shows a plan view of a second reticulated pyroelectric target according to the present invention, and FIG. 7 shows a target such as shown in FIG. 1 retained in an annular holder according to the present invention.

Referring now to FIG. 1, a known reticulated target comprises a number of islands 20 separated by grooves. The sizes of the islands, groove width and depth are carefully controlled.

Referring now more particularly to FIG. 1, each island of the reticulated target is formed by ion beam milling a thin slab of, for example, deuterated triglycine sulphate D.T.G.S. after deposition of a photoresist mask 20 on its uppermost surface. The islands so formed are held together by a semiconductor etch stop layer 21 backed by a nickel chromium signal plate 22 and a polymeric support film 23. The infra red radiation is shown by the curved arrow 24 and the scanning electron beam by the straight arrow 25.

Typical targets 10–30 $\mu$m in thickness with a support film 2–5 $\mu$m thick.

Reticulated structures of this type have provided very significant improvements in Modulation Transfer Function (M.T.F.) and Minimum Resoluble Temperature (M.R.T.) i.e. spatial and thermal resolution over the unreticulated case. The 120° hexagonal structure has furthermore provided an additional improvement over the equivalent square reticulated structure. This is a consequence of the higher number of islands per unit area, the increased thermal resistance between adjacent islands, and the higher coordination of one island by its neighbours (i.e. higher symetry) thus providing more isotropic thermal diffusion.

Figure 2:
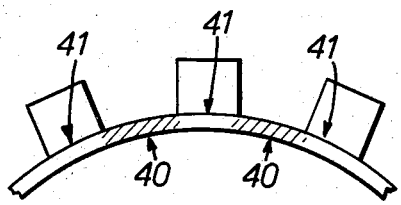
FIG. 2 shows a sectional view of the target of FIG. 1 bent to illustrate the lines of weakness.

The simple square reticulated structure of FIG. 2 however suffers from a defect which detracts from the improvement gained by reticulation of the vidicon target.

The defect is related to the fact that the grooves separating the islands in FIG. 2 are perpendicular to the plane of the target. This means that the scanning electron and ion beams, which scan the side of the target opposite to the support film as shown in FIG. 2 can 'see' the nichrome signal plate exposed at the bottom of the grooves. This can lead to injection of charge into the signal plate, which may account for the problems which have arisen in poling the reticulated targets in the vidicon and the occurrence of pedestal shading. Furthermore, incident infra red radiation falling normally upon the reticulated target will only be absorbed, to a first approximation, in the proportion of the target where TGS or DTGS remains after reticulation. The so-called 'kerf-loss' corresponds to the area of the grooves in the total target area. A simple technique to avoid these problems is to conduct the reticulation at an angle to the normal to the plane of the target. Provided the reticulation angle is greater than $\tan^{-1}b/h$, where b is the width of the groove in the direction of the reticulation ion-beam resolved in to the plane of the target and h is the height of the groove. A very large proportion of the groove area will then appear obscured when viewed perpendicular to the plane of the target, as for the scanning electron and the ion beam and a large proportion of the incident radiation. A reticulation angle of greater than $\tan^{-1}2b/h$ gives total obscuration of the groove area. Sketches of a simple angled reticulated structure are given in FIG. 4, in which the ion beam 30 used to mill grooves 31 is at an acute angle to the major surface of the thin slab of deuterated triglycine sulphate which is held at an angle on on angled blackened water cooled copper pallet 32 during the milling process.

It can be seen that the scanning electron beam 25 of FIG. 1 will not be able to reach the bottom of the grooves of FIG. 4 due to the overhang produced by the angled ion beam milling. The angle of milling required will vary according to whether it is decided to produce complete or only partial obscuration of the signal plate 22 (see FIG. 1) from the scanning electron beam.

The reticulation of such targets also produces problems due to the reticulation process which tends to distort the flat surface of the pyroelectric target during the ion beam milling of the target.

Previously the target has been milled without any restraint and this has been found to cause the target to bow and the reticulation to thereby take place at varying angles. The target has also been restrained by clamping under an annular ring and this has been found to produce wrinkles and folds when the target is released from the annular ring.

The present invention provides, as shown in FIG. 7, apparatus for clamping the target during reticulation which alleviates the above problem.

FIG. 7 shows a clamping means 35 for a pyroelectric target comprising an annular ring 36 provided with a series of inwardly projecting fingers 37 which partially restrain the target 38 shown in dotted outline.

In a preferred embodiment the clamping means 35 may be made by etching a metal foil to produce the desired shape. The advantage of using such a holder is that the target 38 is only restrained at selected points round its periphery and can, therefore, be milled right up to its edge, thus providing strain relief in the target and ensuring that the target remains substantially flat after release from the clamping means.

Further referring to FIG. 9, two possible embodiments of the clamping means 35 may be used: a flat clamping means, and a preferred holder with depressed fingers which is found to give a more uniform partial restraint during reticulation. The reticulation process forms lines of weakness corresponding to the grooves along which the target may fracture or distort if subjected to excessive heat or rough handling. These lines of weakness 40 are illustrated in FIG. 2 in which the target is shown bent into a gentle curve and the rigid portions are indicated at 41.

The design of target shown in FIGS. 5 and 6 provides a stronger target less susceptible to fracture and/or distortion.

Referring now to FIG. 5, the reticulated target comprises a plurality of hexagonal islands 43 of pyroelectric material. The material is preferably either deutrated triglycine sulphate or triglycine sulphate as for FIG. 1 and the islands are preferably formed by ion beam milling. The hexagonal islands of FIG. 5 have 90° and 135° angles as shown and the ion beam milling is carried out at an angle by tilting the target, as shown by the arrow, around the axis A—A. The effect of this tilting is to provide angled sides to the islands as indicated by the dotted lines. The projected ion beam direction is shown by arrow 46.

The approximate scale of a preferred embodiment is given and the groove width and projected target thickness are given respectively at 44 and 45 for FIGS. 3, 5 and 6. The nearest neighbour distances a, b, c shown as dotted lines in FIGS. 2, 5 and 6 are given hereinafter in the table 1 for the arrangements of FIGS. 3, 5 and 6.

Referring now to FIG. 5 the rectangular dotted outline 47 shows the basic block which is reproduced to produce the reticulated target. Within a block 47 there are grooves 48, 49, 50, 51, 52 and portions of grooves 53, 54, 55, 56. It may be seen that it is not possible to draw a straight line through any successive grooves because of the shape of the islands. Thus, the reticulated target is much stronger and, therefore, less liable to distortion.

The electron beam scanning is carried out at an angle substantially orthogonal to the plane of the paper and it may be seen that there are small areas 57, 58 of the signal plate 22 (see FIG. 1) which are exposed to the electron beam. These areas can be eliminated by alteration of the angle of reticulation of the target by increasing the angle of rotation of the target about the axis A—A. The angles for 10% signal plate exposure and no signal plate exposure are given hereinafter in the table.

Referring now to FIG. 6, the same reference numbers have been used with a 120° hexagon and it is seen that the areas 57, 58 are slightly larger. Thus for no signal plate exposure the angle of reticulation must be greater.

FIG. 3 shows the square reticulated target with the reticulation angle produced by rotation about the axis A—A and the ion beam milling angle shown again at 46. The arrangement of FIG. 3 can be made to present no signal plate exposure to the electron beam—see table—but still has the disadvantage of weaknesses due to alignment of the grooves separating the islands 43.

The hexagonal structures illustrated in FIGS. 5 and 6 thus both avoid the lines of weakness of the square pattern shown in FIG. 3 since the grooves separating the islands are no longer aligned. The more isotropic 120° hexagonal structure possesses an increased number of islands (or image points) per unit area compared with the square mask of similar pitch. The improvement in performance to be gained by employing the 120° hexagonal structure over that of the equivalent square structure is illustrated in table 2. The 90°/135° hexagonal structure also permits the use of angled reticulation with targets which are acceptably thin (15 to 30 m) and with a reasonable reticulation angle ($\tan^{-1}\frac{1}{2}$) which requires only a 20 percent increase in reticulation time over the normal case.

The properties for the masking technique are given in table 1 in which details of the two hexagonal mask patterns are given with the square mask pattern included by way of comparison.

TABLE 1

RETICULATION MASKING PATTERN DESIGN DATA

| PARAMETER | UNITS | 750 LINES/INCH SQUARE | 34 MICRON 120° HEXAGON | 34 MICRON 90/135° HEXAGON |
|---|---|---|---|---|
| GAP WIDTH | μm | 6.8 | 5.6, 6.0 | 5.6, 6.0 |
| NEAREST NEIGHBOUR DISTANCES* | | (a) 47.9 | (a) 33.8 | (a) 37.1 |
| | μm | (b) 33.9 | (b) 34.0 | (b) 34.0 |
| | | (c) 47.9 | (c) 33.8 | (c) 37.1 |
| GROOVE AREA | % | 36 | 31.8 | 30.1 |
| ISLANDS | $mm^{-2}$ | 872 | 1014 (+16%) | 891 (+2%) |
| 'FLEX' LINES | | YES | NO | NO |
| ANGLED RETICULATION AT $\tan^{-1}\frac{2}{3}$ | | | | |
| MINIMUM TARGET THICKNESS FOR | | | | |
| (a) 10% SIGNAL PLATE EXPOSED | μm | 14.4 | 18 | 12 |
| (b) NO SIGNAL PLATE EXPOSED | μm | 28.8 | 36 | 24 |

TABLE 2

COMPARISON OF THERMAL MODULATION TRANSFER FUNCTIONS OF RETICULATED AND UNRETICULATED DTGS TARGETS

| Cycles /mm | Equivalent lines/18mm Diameter | MTF, % Unreticulated | Square* Reticulation | 120° Hexagonal Reticulation |
|---|---|---|---|---|
| 1.4 | 50 | 100 | 100 | 100 |
| 1.9 | 70 | 94 | 100 | 100 |
| 2.8 | 100 | 70 | 90 | 90 |
| 3.9 | 150 | 40 | 74 | 78 |
| 5.6 | 200 | 17 | 50 | 62 |
| 8.3 | 300 | immeasurable | 27 | 38 |

*Reticulation Pitch 34μms, Groove width 6μms

What is claimed is:

1. A reticulated pyroelectric target for the detection of thermal radiation and having a target surface, and comprising a plurality of islands of pyroelectric material disposed on said target surface and separated by a plurality of grooves, each said groove adjacent each said island forming a portion of a boundary of each said island, each said groove being limited in length to and coinciding with said portion of said boundary of each said island, and wherein each groove in respect to any one said island forms, at its junction with adjacent grooves of adjacent said islands, all non-straight lines with the adjacent grooves of adjacent said islands, whereby to minimize lines of weakness and improve structural strength over the target surface.

2. A reticulated pyroelectric target as claimed in claim 1, wherein each island is hexagonal in shape, and wherein the plurality of islands forms a close packed hexagonal array.

3. A reticulated pyroelectric target as claimed in claim 2, wherein the hexagonal islands are formed with internal angles of 120°.

4. A reticulated pyroelectric target as claimed in claim 2, wherein the hexagonal islands are formed with internal angles of 135° and 90°.

5. A reticulated pyroelectric target as claimed in claim 1, wherein the target comprises a structure having a pitch, said target detecting infra-red radiation having a wavelength, and wherein the grooves have a width which is less than $\frac{1}{4}$ the pitch of the structure and less than the wavelength of the infra-red radiation being detected.

6. A reticulated pyroelectric target as claimed in claim 1, wherein the grooves separating the islands are inclined at an acute angle with respect to the plane of the target.

7. A reticulated pyroelectric target as claimed in claim 1, wherein the target is produced using a holder for retaining the target substantially flat during reticulation of the target, said holder comprising a plurality of fingers, and at least one annular support means for supporting said plurality of fingers, said plurality of fingers projecting inwardly from said at least one annular support means, said at least one annular support means being provided with a central aperture such that said at least one annular support means does not cover the whole of the target during reticulation.

8. A reticulated pyroelectric target as claimed in claim 7, wherein the reticulations extend to the extreme edges of the disc so as to relieve the stresses produced during the reticulation process.

* * * * *